United States Patent [19]

Bartz

[11] Patent Number: 4,506,824

[45] Date of Patent: Mar. 26, 1985

[54] PAPER CUTTER

[75] Inventor: Stephen A. Bartz, Jordan, Minn.

[73] Assignee: Lucht Engineering, Inc., Minneapolis, Minn.

[21] Appl. No.: 349,648

[22] Filed: Feb. 17, 1982

[51] Int. Cl.[3] ..... B26D 5/32

[52] U.S. Cl. ..... 234/28; 83/71; 83/214; 83/371; 234/38; 234/63

[58] Field of Search ..... 83/71, 371, 209–211, 83/213, 214, 255; 234/25–29, 42–48, 38, 63, 64; 355/28, 29

[56] References Cited

U.S. PATENT DOCUMENTS

| | | | |
|---|---|---|---|
| Re. 28,732 | 3/1976 | Von Hofe | 83/214 X |
| 3,117,717 | 1/1964 | Duran | 234/108 |
| 3,130,903 | 4/1964 | Parry, Jr. et al. | 234/63 |
| 3,525,471 | 8/1970 | Keen | 234/108 X |
| 3,790,071 | 2/1974 | Der Estephanian | 83/255 X |
| 4,239,377 | 12/1980 | Rasmussen, Jr. | 83/575 X |
| 4,257,551 | 3/1981 | Buchmann | 234/63 X |

*Primary Examiner*—James M. Meister

*Attorney, Agent, or Firm*—Kinney & Lange

[57] ABSTRACT

A paper cutter for separating exposure areas positioned along the longitudinal axis of a web of photographic material. Individual print areas within an exposure area are also separated. The print material is coded on its back or at each exposure area border in accordance with the particular array of print areas and the cutter decodes the border code and produces a signal representative of the array of print areas to be separated. The web is advanced into a cutting station with cutting elements within the cutting station being selectively activated, web advance and cutting station activation being in accordance with the print area array representative signal.

15 Claims, 4 Drawing Figures

PAPER CUTTER

DESCRIPTION

Background of Prior Art

Photographic printers are known to the prior art. Automatic printers typically include supply and take-up rollers for photosensitive photographic material and a mechanism to automatically advance the material through an exposure area or station. The image to be exposed is estabilished in known manner and projected on the photographic material in the exposure area. A shutter is employed to control the exposure.

An example of the type of printer discussed above is disclosed in U.S. Pat. No. 3,951,545 issued Apr. 20, 1976, in the name of Orren J. Lucht for PHOTOGRAPHIC PRINT APPARATUS which is commonly owned with the present invention and which is hereby incorporated by reference. The printer of this patent employs an interchangeable lens assembly formed of stacked, alternative lens configurations. That is, the different lens configurations are spaced from each other along the general direction of the printer optical path. They are movable, within the lens assembly, between first and second positions—one of those positions being within the optical path of the printer with the other being without the optical path. Selectively actuated plungers are operative to position the desired lens configuration within the printer's optical path.

The printer of the above-incorporated patent provides greater flexibility than other prior art printers and has contributed significantly to the photographic printing industry. Its output is a roll of exposed photographic material which, when processed, produces a roll bearing photographic prints of varying sizes. That is, each exposure results in exposure areas of varying sizes with one or more print areas within each exposure area, all dependent on the lens configuration employed. This size variation complicates the efficient separation of adjacent exposure areas from each other as well as the separation of the individual prints.

A marking system is disclosed in U.S. Pat. No. 4,239,377 issued Dec. 16, 1980, in the name of William R. Rasmussen, Jr., for PHOTOGRAPHIC PRINTER which is commonly owned with the present invention and which is hereby incorporated by reference. This and other marking systems have been employed to indicate the location of the border between adjacent exposure areas allowing an automatic separation of one exposure area from another, as by cutting, for example. Typically, the marking is by punching or through the use of a graphite wheel, with punching being preferred by many people. However, the marking used heretofore has only indicated the location of the border between adjacent exposure areas without providing any indication as to how individual print areas are arranged within the exposure area. Thus, the cutting operation has not been as fully automated as the printing operation.

BRIEF SUMMARY OF INVENTION

The present invention provides a paper cutter which not only separates exposure areas on a web of photographic material but also separates individual print areas within an exposure area. During the printing operation, the print material is coded on its back or at the border of adjacent exposure areas in accordance with the particular array of print areas being exposed. The coding may be accomplished by punching or any other suitable marking approach. Punching at the border between adjacent exposure areas is preferred. The cutter decodes the code and produces a control signal representative of the array of print areas to be separated. A cutting station is provided with a plurality of blades each selectively movable to cut portions of a web positioned at predetermined locations within the cutting station with movement of the web and movement of the cutting blades being controlled in accordance with the print area array representative signal.

In a preferred embodiment the cutting is accomplished with a punch and die system with a plurality of punches and dies being aligned generally perpendicular to and parallel with the longitudinal axis of the web. The web is moved in the general direction of its longitudinal axis through a first cutting station substation wherein the generally parallel punch and dies are contained to a second substation wherein the generally perpendicular punches and die are contained. In this manner, after the web is operated on in the first substation, a force imparted to the web will still cause the exposure area being cut to advance to the second substation. A preferred punch configuration includes two punches at the second substation in butting relation to each other and employing a common die, the combined length of the two punches and the length of the die being at least equal to the transverse dimension of the web. The length of the generally parallel punches and dies are generally equal to the smallest print area dimension along the web longitudinal dimension, each print area array being one of a predetermined plurality of print area arrays.

DETAILED DESCRIPTION OF INVENTION

Figure 1:
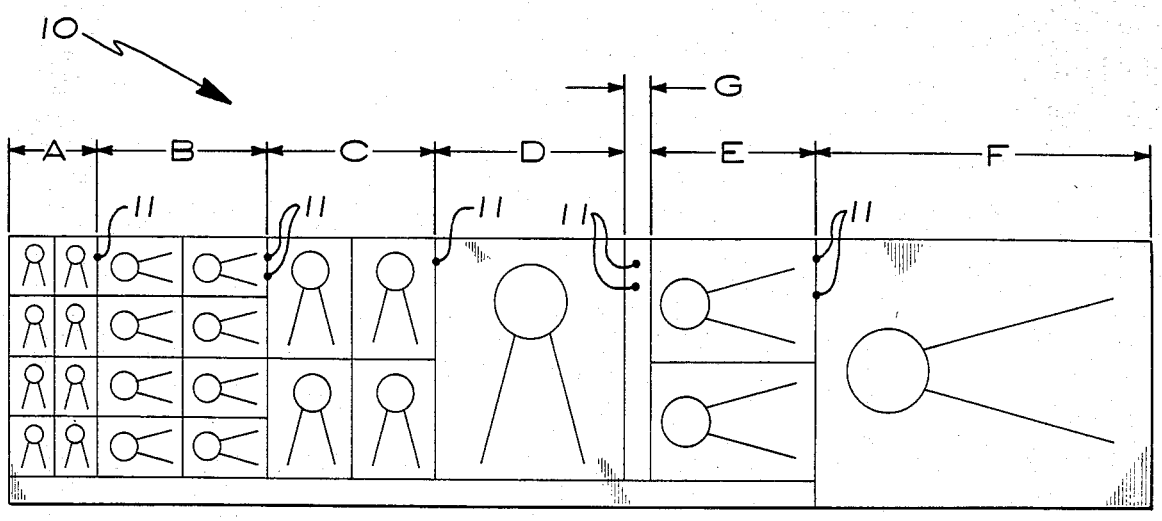
FIG. 1 illustrates a web of exposed photographic material which cooperates within the present invention.

Referring now to FIG. 1, there is illustrated an image bearing web of photographic material designated generally at 10. In most instances, the web which cooperates within the present invention will be both exposed and processed such that the exposed images are visible. However, the present invention has application to an exposed but unprocessed web as well as to an unexposed web so long as the desired exposure areas and print areas are predetermined. In most instances, practicality will require that the web be both exposed and processed. Also, FIG. 1 illustrates a web in the form of an elongated sheet. In most instances, the web which cooperates within the present invention will be in the form of a roll of photographic material, such rolls being known to the prior art.

The web illustrated in FIG. 1 contains a plurality of exposure areas positioned along the longitudinal axis of the web and designated along that axis as areas A–F. Each of the exposure areas contain one or more prints or print areas, exposure area A containing eight print areas while exposure area F contains one print area. Typically, each print area within an exposure area will be the same size, although proper baffling and exposure techniques may result in print areas within an exposure area of differing sizes. Within the context of the present invention, each print area array within an exposure area is one of a predetermined plurality of print area arrays. That is, each print area array is standardized so as to be readily symbolized by a code, a binary code, for example.

Still referring to FIG. 1, the border between exposure area A and exposure area B is a line defined by the edges of those exposure areas, with little or no space at the border. In contrast, the border between exposure area D and exposure area E is an unexposed gap designated at G, the gap G being defined by the edges of the exposure area D and exposure area E. Obviously, for the sake of print material economy, it is preferable to expose the print material such that the border between adjacent exposure areas has no gaps, an accomplishment easily attainable with modern-day exposure techniques, including exposure via the printer of the patent incorporated above.

Inasmuch as each of the print area arrays within a given exposure area is one of a predetermined plurality of print area arrays, it can be defined uniquely by a code, one code character being estabilished for each of the different print area arrays. For example, a binary code may be employed to provide a plurality of unique code characters with each code character representing a different print area array. The number of bits necessary within such a code character will be determined by the number of print area arrays it is desired to distinguish between. The code may be placed at the border between adjacent exposure areas to define the print array of one of those adjacent exposure areas. The code may be placed by marking in any desired manner, punching being preferred. In this manner, at a predetermined bit location along an exposure area border, a punch may represent a logic 1 with the absence of a punch representing a logic 0. Such coding, as by punching, is known to the prior art although it is believed that it has not been applied to the present application. Markings in accordance with the present invention are illustrated at 11 in FIG. 1.

Figure 2:
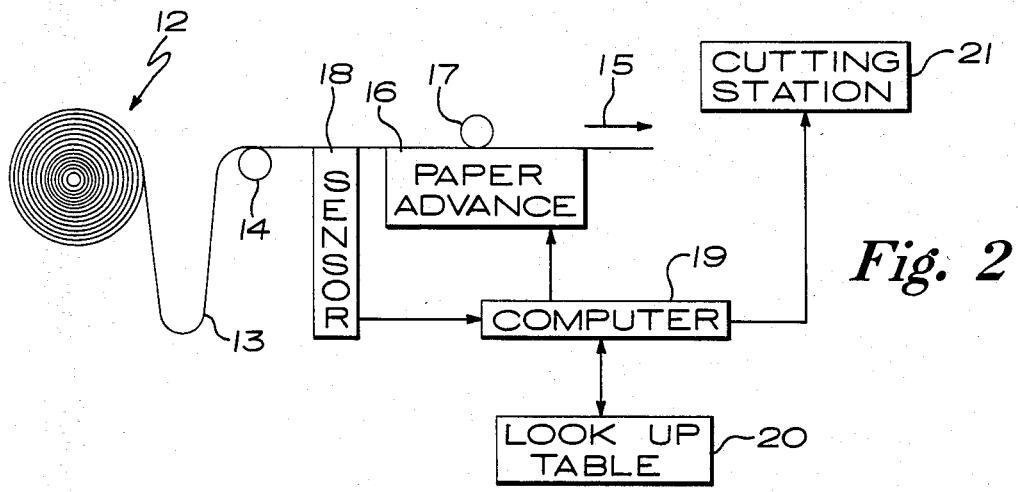
FIG. 2 is a diagrammatic illustration of the various functional aspects of the present invention.

FIG. 2 diagrammatically illustrates the paper cutter of the present invention including a roll of exposed and coded photographic material designated generally at 12, the material coming off the roll forming a loop 13 and passing a guide roll 14 to be advanced in the direction of the arrow 15. Preferably, the exposed web of photographic material withdrawn from the roll 12 will be processed such that the marks 11 of FIG. 1, if formed by exposure techniques, will be detectable. However, it is preferable that the code marks 11 be formed by punching as through the use of a punch similar to that described in the patent incorporated above. Of course, the incorporated patent shows but a single punch for identifying the border between adjacent exposure areas while the coding of the present invention requires multiple punching at specified locations along the exposure area border in accordance with the print area array of one exposure area adjacent to the border.

The loop 13 is an isolation loop intended to isolate the remainder of the system from the inertia of the paper roll 12. Such systems are known to the prior art and may include a loop detector to control a motor which controls the speed of rotation of the roll 12 to control the amount of photographic print material withdrawn from the roll 12. The paper is advanced by a paper advance 16 which may have a cooperating idler roller 17. Preferably the paper advance 16 is a stepper motor controlled in a manner to be described below to provide precise registration within the system illustrated in FIG. 2. As the web advances in the direction of the arrow 15, it passes over a sensor 18 which detects the border code relaying the detected information to a computer 19. The computer 19 decodes the border code information and employes a look-up table 20, in known manner, to determine the appropriate control sequence for the paper advance 16 through a cutting station 21. As noted above, the border code may be for either of the adjacent exposure areas, the particular one of the adjacent exposure areas to which it relates affecting only the information contained in the look-up table and, accordingly, the particular controll sequence under the control of the computer 19. The computer 19 produces a signal to the paper advance 16 to effect the desired control sequence causing it to advance the web in the direction of the arrow 15 through the cutting station 21, the computer selectively actuating the cutting elements within the cutting station 21 to result in a separation of adjacent exposure areas as well as individual print areas within the exposure area.

The sensor 18 will be dependent on the particular type of marking employed, punching being preferable, while the computer 19 and the use of a look-up table 20, as well as the paper advance 16, may be of any type known to the prior art. The interaction of these elements and the programming of the computer and computation of the look-up table are known to those familiar with the art.

Figure 3:
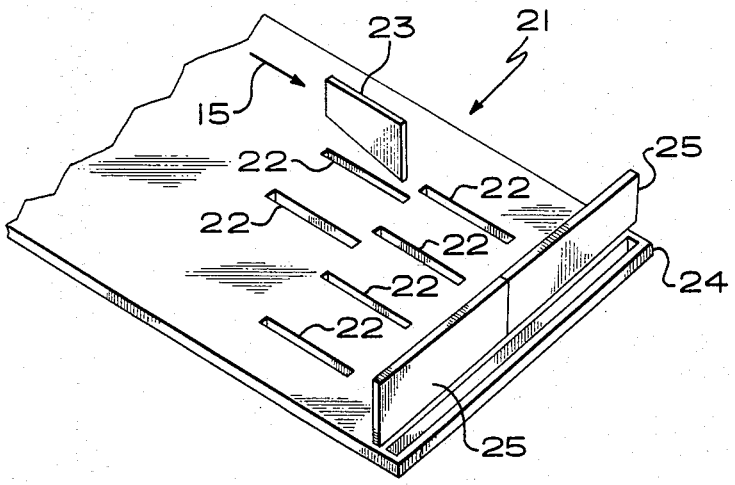
FIG. 3 illustrates a portion of a preferred embodiment of the present invention.

Cutting station 21 includes a plurality of cutting blades in predetermined positions corresponding to the cuts necessary to separate the exposure areas and the print areas within the predetermined print area arrays. FIG. 3 illustrates a preferred embodiment of a cutting station 21, the cutting elements or blades being in the form of punches and cooperating dies. Arrow 15 in FIG. 3 again illustrates the desired movement direction of the web of photographic material, along its longitudinal axis. A plurality of dies 22 are positioned in a first cutter substation generally parallel with the movement direction 15 of the web of photographic material with each having a cooperating punch 23 (one shown for the sake of clarity). The position of the dies 22, and cooperating punches 23 are determined in accordance with the predetermined print area arrays so as to be able to separate each print area from the others within the predetermined print area arrays. The length of the dies 22 and punches 23 generally corresponds to, or is at least no longer than, the shortest dimension along the longitudinal axis of the web of a print area which it is intended to separate. In FIG. 1, this would be one half of the web longitudinal dimension of area A. Of course, longer cuts will require incremental advances of the web through the cutter substation formed by the dies 22 and punches 23.

A second cutter substation is formed by a die 24 and associated punches 25, the die 24 and punches 25 being arranged generally perpendicular to the desired direction of movement of the web 15. Die 24 is a single die while the punches 25 are dual punches in butting relation to each other. They may be activated selectively, or in tandem, depending on the dimension it is desired to cut, the combined length of the punches 25 being at least that of the lateral dimension of the web of photographic material. It is presently contemplated that each of the punches 23 and 25 will have a cutting edge that is perpendicular to the sides of the punches while being tapered along its length at an angle of approximately 6°.

Figure 4:
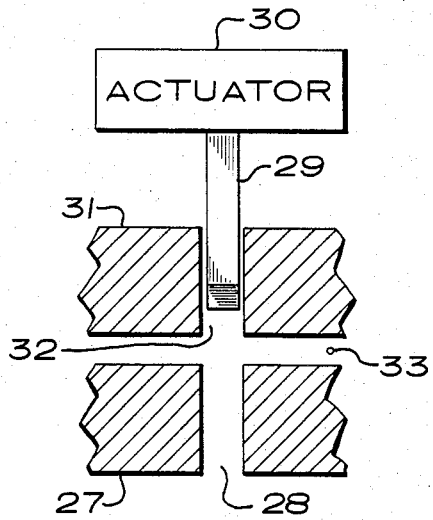
FIG. 4 illustrates the cooperation of the elements of FIG. 3 and other cooperating structures.

FIG. 4 illustrates the operation of the punches 23 and 25 and the dies 22 and 24 of FIG. 3 which may be generally similar. A lower plate 27 is provided with a die 28 (corresponding to dies 22 and 24) into which a punch 29 (corresponding to does 23 and 25) will advance to remove that material overlying the die 28. The punch 29 may be activated in any desired manner by an actuator 30, pneumatic cylinders being presently preferred because of the general availability of air under pressure in photographic laboratories. A stripper 31 is positioned over the plate 27 and has an aperture 32 through which the punch 29 advances into the die 28 and which guides the punch 29 to the die 28. A gap 33 between the stripper 31 and plate 27 provides a passage for the photographic material to be severed, with the stripper 31 also serving to maintain that photographic material in a flat orientation during movement while also facilitating a removal of the die 29 from that material after the cutting action has taken place. The thickness of the die 29, at least in the second cutter subsection formed by die 24 and punches 25 should be at least as great as the marks at the border between adjacent exposure areas such that those marks are removed during the severing operation. It is presently contemplated that the dies 23 and 25 will have a nominal dimension of 0.050 inches with the stripper opening 32 being 0.051 inches and the die opening 28 being 0.052 inches.

Obviously, many modifications and variations of the present invention are possible in light of the above teachings. For example, the dies 24 may be positioned ahead of the dies 22, together with their associated punches, to be selectively activated under the control of the computer 19, as by selectively activating an actuator 30 (see FIG. 4) associated with the punch and die in question. Further, the punches 25 may be a single punch the length of die 24 for many applications or may be a single, stepped punch. However, it is believed preferable that the first substation to which the web to be severed is advanced be that formed of punches and dies generally parallel to the direction of advance such that subsequent advances of the web will result in an advance of the already severed material through the first situation into a second substation formed by the die 24 and two punches 25. Also, the particular configuration of dies 22 and punches 23 is dependent upon the predetermined print area arrays with any number of dies 22 and punches 23 falling within the scope of the present invention. Further, the particular coding may be by any coding technique which may be read and decoded and still fall within the ambit of the present invention, including a marking of the web on the surface opposite the exposed surface. It is therefore to be understood that, within the scope of the appended claims, the invention may be practiced otherwise than as specifically described.

I claim:

1. A paper cutter for separating exposure areas of varying sizes positioned along the longitudinal axis of a web of photographic material and for separating individual print areas within an exposure area including at least some print areas positioned relative to each other along the transverse axis of the web of photographic material, the photographic material being uniquely coded for each exposure area in accordance with the particular array of print areas to be separated and the cutter including means for decoding the code and producing a signal uniquely representative of the array of print areas to be separated, the cutter further comprising:

cutting station means including a plurality of blade means selectively movable to cut portions of said web positioned at predetermined locations within said cutting station means;

means responsive to said signal for selectively moving said blade means in accordance therewith; and means responsive to said signal for advancing said web through said cutting station means by an amount established by said signal.

2. The paper cutter of claim 1 wherein the photographic material is coded at the border between adjacent exposure areas, said signal being representative of the array of print areas to be separated within one of the adjacent exposure areas.

3. The paper cutter of claim 1 further comprising die means at said predetermined cutting station locations, said blade means comprising punch means cooperating with said die means.

4. The paper cutter of claim 1 wherein said web advancing means moves the web in the general direction of its longitudinal axis, said blade means comprising a plurality of elongated blade means aligned generally perpendicular to the web movement direction and a plurality of elongated blade means aligned generally parallel to the web movement direction.

5. The paper cutter of claim 4 further comprising die means at said predetermined cutting station locations, said blade means comprising punch means cooperating with said die means.

6. The paper cutter of claim 5 wherein the punch means generally perpendicular to the web movement direction comprise two punch means in butting relation to each other.

7. The paper cutter of claim 6 wherein the combined length of said two punch means is at least equal to the transverse dimension of the web.

8. The paper cutter of claim 4 wherein said generally parallel blade means are positioned within a first substation of said cutting station means and said generally perpendicular blade means are positioned in a second substation of said cutting station means, said advancing means moving said web through said first substation to said second substation.

9. The paper cutter of claim 8 wherein each print area array within an exposure area is one of a predetermined plurality of print area arrays, said generally parallel blade means having a length generally equal to the smallest print area dimension along said web longitudinal dimension within said predetermined plurality of print area arrays.

10. The paper cutter of claim 9 further comprising die means at said predetermined cutting station locations, said blade means comprising punch means cooperating with said die means.

11. The paper cutter of claim 10 wherein the punch means generally perpendicular to the web movement direction comprise two punch means in butting relation to each other.

12. The paper cutter of claim 11 wherein the combined length of said two punch means is at least equal to the transverse dimension of the web.

13. The paper cutter of claim 1 wherein said code comprises one or more punched holes of predetermined dimensions.

14. Apparatus for separating individual print areas from arrays of print areas of varying sizes positioned along the longitudinal axis of a web of photographic material, at least some print area arrays including print areas positioned relative to each other along the transverse axis of the photographic material web and the photographic material being uniquely coded for each array of print areas in accordance with the print areas to be separated, the apparatus including means for decoding the code and producing a signal uniquely representative of the array of print areas to be separated and further comprising;

separating station means including means selectively operable for separating portions of said web at a plurality of predetermined locations within said separating station means;

means responsive to said signal for selectively operating said portions separating means in accordance therewith; and means responsive to said signal for advancing said web through said separating station means by an amount established by said signal.

15. The apparatus of claim 14 wherein the photographic material is coded at the border between adjacent arrays of print areas, said signal being representative of those print areas to be separated of one of the adjacent arrays of print areas.

* * * * *